US008043476B2

(12) United States Patent
Haigh et al.

(10) Patent No.: US 8,043,476 B2
(45) Date of Patent: Oct. 25, 2011

(54) COATED PAPER AND PAPERBOARD

(75) Inventors: John Robert Haigh, Roquefort les Pins (FR); Ravi Mukkamala, Lansdale, PA (US)

(73) Assignee: Rohm and Haas Company, Philadelphia, PA (US)

( * ) Notice: Subject to any disclaimer, the term of this patent is extended or adjusted under 35 U.S.C. 154(b) by 778 days.

(21) Appl. No.: 11/978,348

(22) Filed: Oct. 29, 2007

(65) Prior Publication Data

US 2008/0115900 A1 May 22, 2008

(30) Foreign Application Priority Data

Nov. 20, 2006 (EP) ..... 06291798

(51) Int. Cl.
*D21H 19/38* (2006.01)
*D21H 19/56* (2006.01)

(52) U.S. Cl. ..... 162/168.1; 162/158; 162/164.1; 162/181.1; 162/181.2; 162/181.4; 162/181.8; 526/274; 526/277; 526/317.1; 526/318; 526/319

(58) Field of Classification Search ..... 162/158, 162/164.1, 168.1, 181.1–181.8; 526/240, 526/274, 277, 317.1, 318, 319, 324; 558/70; 568/8

See application file for complete search history.

(56) References Cited

U.S. PATENT DOCUMENTS

| | | | | | |
|---|---|---|---|---|---|
| 2,500,972 | A | | 3/1950 | Wilson | |
| 3,404,112 | A | * | 10/1968 | Lindemann et al. | 524/809 |
| 3,812,072 | A | | 5/1974 | Kuehlkamp et al. | |
| 4,110,285 | A | | 8/1978 | Pons et al. | |
| 4,609,434 | A | | 9/1986 | Greene et al. | |
| 4,771,086 | A | | 9/1988 | Martin | |
| 5,308,890 | A | * | 5/1994 | Snyder | 523/201 |
| 5,385,960 | A | | 1/1995 | Emmons et al. | |
| 5,939,514 | A | * | 8/1999 | Brown et al. | 528/229 |
| 6,063,857 | A | * | 5/2000 | Greenblatt et al. | 524/561 |
| 6,194,522 | B1 | * | 2/2001 | Brown | 525/374 |
| 6,214,467 | B1 | * | 4/2001 | Edwards et al. | 428/407 |
| 6,395,836 | B1 | * | 5/2002 | Shinoda | 525/222 |
| 6,437,070 | B1 | * | 8/2002 | Parker et al. | 526/325 |
| 6,545,084 | B2 | * | 4/2003 | Brown et al. | 524/556 |
| 6,576,051 | B2 | * | 6/2003 | Bardman et al. | 106/436 |
| 6,710,161 | B2 | * | 3/2004 | Bardman et al. | 528/398 |
| 6,890,983 | B2 | * | 5/2005 | Rosano et al. | 524/401 |
| 7,217,443 | B2 | * | 5/2007 | Bobsein et al. | 427/428.01 |
| 7,732,525 | B2 | * | 6/2010 | Branston et al. | 524/501 |
| 2003/0059599 | A1 | * | 3/2003 | Beckley et al. | 428/327 |
| 2003/0088014 | A1 | * | 5/2003 | Edwards et al. | 524/523 |
| 2004/0054063 | A1 | * | 3/2004 | Brown et al. | 524/500 |
| 2004/0122131 | A1 | * | 6/2004 | Brown et al. | 523/160 |
| 2004/0220329 | A1 | * | 11/2004 | Solomon et al. | 524/804 |
| 2006/0042768 | A1 | | 3/2006 | Brown et al. | |
| 2006/0047062 | A1 | * | 3/2006 | Hsu et al. | 524/556 |

FOREIGN PATENT DOCUMENTS

| | | |
|---|---|---|
| WO | WO 93/11181 | 6/1993 |
| WO | WO 02/059421 A2 | 8/2002 |

OTHER PUBLICATIONS

J. Peel, Paper Science & Paper Manufacture 1999, pp. 18-19.*
Smook, Gary A., Handbook for Pulp and Paper Technologists, 2nd ed, Angus Wilde Publications, 1992, pp. 284 and 288.*
"Filler Minerals Reference, A Guide to Filler Properties and Uses," Information Sheet [online] R.T. Vanderbilt Company, Inc.. 2008, [retrieved on Jan. 20, 2011], Retrieved from the Internet: <URL: http://www.rtvanderbilt.com/VR703forweb.pdf>.*
Heng, L. et al, "Influence of Methacrylic-Acrylic Copolymer Composition on Plasticiser-free Optode Films for pH Sensors", Sensors, 3, pp. 83-90 (2003) [retrieved on Jan. 20, 2011], Retrieved from the Internet: <URL: http://www.mdpi.com/1424-8220/3/4/83/pdf>.*
Database WPI Week 199333, XP002435488, Derwent Publications LTD,London, GB; AN 1993-262345 & KR 920 008 778 B (Cheonju Paper Co), Sep. 10, 1992.

* cited by examiner

*Primary Examiner* — Matthew Daniels
*Assistant Examiner* — Dennis Cordray
(74) *Attorney, Agent, or Firm* — Stephen T. Falk

(57) ABSTRACT

A paper or paper board coated with an aqueous paper coating composition containing pigment having a phosphorous-containing emulsion polymer and a phosphorous-containing dispersant.

10 Claims, No Drawings

COATED PAPER AND PAPERBOARD

This application claims the benefit of priority under 35 U.S.C. §119(e) of European Patent Application No. 06291798.4, filed on Nov. 20, 2006, the disclosure of which is incorporated herein by reference.

This invention relates to a paper or paperboard coated with a coating having a phosphorous-containing latex and pigment.

Acrylic polymers having phosphorus-containing functional groups are known for their pigment dispersant capabilities in aqueous coating compositions (see, e.g., U.S. Pat. No. 5,385,960). Such polymers have also been suggested for use for making composite paper sheets with high filler levels (see, e.g., U.S. Pat. No. 4,609,434). This latter patent warns, however, that such phosphorous-containing latexes can flocculate and thus be unsuitable for paper coatings. It then states that such latexes can be stabilized to a degree by copolymerizing ethylenically unsaturated carboxylic acids (such as acrylic acid) into such polymers. However, we found that copolymerizing latexes with acrylic acid does not impart sufficient viscosity stability.

This invention is a paper or paper board product comprising a paper (uncoated basis weight: 35-178 gsm) or paperboard (uncoated basis weight: 195-586 gsm) that bears (e.g., coated on one or both sides as a base coat or top coat (or any of the middle coats in case of multiple coatings applications) with) an aqueous coating composition comprising:

(a) pigment particles;

(b) particles of acrylic or vinyl polymer containing phosphate or phosphonate groups; and (c) one or more compounds selected from a polyphosphate compound, or a compound of formulae (I) or (II):

(I)

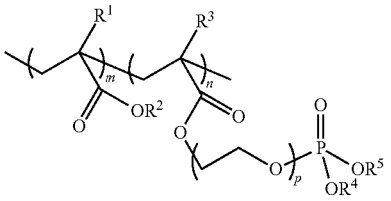

(II)

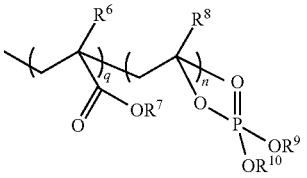

R1, R3, R6, R8 are independently hydrogen or alkyl groups, R2, R4, R5, R7, R9 & R10 are independently hydrogen, alkyl groups or ammonium or metal counter ions, or wherein R5 is a residue of a phosphoethyldimethacrylate that is in turn optionally polymerized with other ethylenically unsaturated monomers or dimmers; wherein each of the sums (m+n) and (q+r) is an integer from 10 to 600, and p is an integer from 1-10; and wherein each of the ratios m:n and q:r is from 0:100 to 95:5.

Some of the polymeric structures of Formula (I) or (II) are water soluble.

By "polyphosphate compound(s)," we mean linear or cyclic polyphosphate(s) at described by Cotton et al., *Advanced Inorganic Chemistry, A Comprehensive Text*, Interscience Publishers (1972), p. 397.

Preferred compounds polyphosphates include, e.g., the acid form, or the alkali metal or ammonium salts of: pyrophosphates, tripolyphosphates, metaphosphates and polymetaphosphates [for example, $(NaPO_3)_x$, such as sodium hexametaphosphate where x=6 or other similar structures with x is higher than 6. In a preferred embodiment of the invention, the sodium salts are used.

The weight ratio of the phosphorous-containing acrylic polymer binder to the polyphosphate compound(s) (and/or compounds of Formulae (I) or (II)) can preferably range from 1:0.001 to 1:2, more preferably from 1:0.01 to 1:0.5, and most preferably from 1:0.03 to 1:0.3.

All percentages are weight percentages, unless specified otherwise. The term "acrylic polymer" refers to a polymer comprising at least 40% monomer units derived from among the following acrylic monomers: acrylonitrile (AN); acrylamide (AM), methacrylamide, and their N-substituted derivatives; acrylic acid (AA), methacrylic acid (MAA), and itaconic acid (IA) and their esters. The terms (meth)acrylic and (meth)acrylate refer to acrylic or methacrylic, and acrylate or methacrylate, respectively. Esters of AA and MAA include, but are not limited to, methyl methacrylate (MMA), ethyl methacrylate (EMA), butyl methacrylate (BMA), ethylhexyl methacrylate (EHMA), lauryl methacrylate (LMA), hydroxyethyl methacrylate (HEMA), methyl acrylate (MA), ethyl acrylate (EA), butyl acrylate (BA), ethylhexyl acrylate (EHA) and hydroxyethyl acrylate (HEA), as well as other esters of AA or MAA, e.g., alkyl, hydroxyalkyl and aminoalkyl esters; phosphoalkyl (meth)acrylates. Phosphoalkyl (meth)acrylates include, e.g., phosphoethyl methacrylate (PEM), phosphopropyl (meth)acrylate, phosphobutyl (meth) acrylate. Derivatives of acrylamide include, e.g., methylol acrylamide (MLAM). Acrylic polymers also may contain monomer units derived from other ethylenically unsaturated monomers, e.g., styrene or substituted styrenes; other α,β-unsaturated carboxylic acids, esters and amides; vinyl esters or halides; etc. Preferably, an acrylic polymer contains at least 50% monomer residues derived from acrylic monomers, more preferably at least 60%, and most preferably at least 70%; preferably an acrylic polymer is substantially free of monomer units other than those of AA, MAA and their esters. An "acrylic-styrene copolymer" is a polymer at least 50% of whose monomer units are derived from among AA, MAA, esters of AA and MAA, and styrene monomers. Styrene monomers include styrene (Sty) and substituted styrenes, e.g., α-methylstyrene (AMS). Preferably, acrylic-styrene copolymers contain less than 20% of monomer units other than styrene or acrylic monomer units, more preferably less than 10%, and most preferably less than 5%. Preferably, a polymer in this invention is present in the form of a latex. The polymer may be unimodal or bimodal, see, e.g., U.S. Pat. No. 6,818,697.

The aqueous composition of this invention comprises an acrylic polymer containing phosphate or phosphonate groups. In one embodiment of the invention, these groups are present in the form of monomer residues from phosphate- or phosphonate-containing monomers, including, e.g., phosphoalkyl (meth)acrylates such as phosphoethyl (meth)acrylate, phosphopropyl (meth)acrylate, and phosphobutyl (meth)acrylate, phosphoalkyl crotonates, phosphoalkyl maleates, phosphoalkyl fumarates, phosphodialkyl (meth) acrylates, phosphodialkyl crotonates, and allyl and vinyl phosphate. For purposes of this invention, phosphoalkyl (meth)acrylates include ethylene oxide condensates of (meth) acrylates such as $H_2C{=}C(CH_3)COO(CH_2CH_2O)_nP(O)$ $(OH)_2$, where n is from 1 to 50. The phosphate- or phosphonate-containing polymer may be the only acrylic polymer in the composition, or it may be blended with an acrylic polymer not containing phosphate or phosphonate groups. Preferably, the phosphate- or phosphonate-containing monomer units comprise from 0.5% to 8% of the total amount of acrylic polymer(s) on a solids basis, more preferably from 1% to 5%.

The composition used in or on the paper or paper board of this invention comprises one or more types of pigment particles. Examples of pigments include, but not limited to mineral pigments such as ground and precipitated calcium carbonate, kaolin, calcined clay, delaminated and structured clay, titanium dioxide, aluminum silicate, magnesium silicate, zinc oxide, iron oxide, magnesium carbonate, amorphous silica, zinc hydroxide, aluminum oxide, aluminum hydroxide, talc, satin white, barium sulfate and calcium sulfate, and combinations of these materials. Pigments useful in this invention can also include various polymeric plastic pigments including, but not limited to solid bead, voided, multi-voided, binder-coated, charged, etc. and their combinations. Preferably, the composition of this invention comprises calcium carbonate. Calcium carbonate can be ground-type (GCC) or precipitated-type (PCC) of varying particle size, shape and morphologies.

Preferably, the total amount of latex polymer in the coating composition for 100 parts (dry) of total pigments combined is 1-25 parts (dry) more preferably from 3-18 parts (dry) and most preferably 5-15 parts (dry).

In one embodiment of the invention, the acrylic polymer containing phosphate or phosphonate groups has a $T_g$ from −30° C. to 60° C. Preferably, the $T_g$ is from −25° C. to 45° C., and most preferably from −20° C. to 35° C. $T_g$ is calculated using the Fox equation (T. G. Fox, Bull. Am. Physics Soc., vol. 1 (3), page 123 (1956)). Preferably, the weight average molecular weight ($M_w$) of the acrylic polymer is 50,000-1,500,000, more preferably at least 200,000-1,200,000, and most preferably at least 500,000-800,000.

Particle size ranges: preferably 50-500 nm, more preferably 60-350 nm and most preferably 80-300 nm. When the composition of this invention is formulated as a coating, other conventional binders known in the paper coatings art can be added in combination of the phosphorous-containing latex. Such additional binders include (but not limited to), acrylates, styrene-acrylates, vinyl acetates, vinyl acetate-acylates, SBRs (including SB and SBAs), etc.

When the composition of this invention is formulated as a coating, other conventional coatings adjuvants typically are added, for example, tackifiers, emulsifiers, buffers, neutralizers, thickeners or rheology modifiers, humectants, wetting agents, biocides, plasticizers, antifoaming agents, optical brightening agents (OBAs), colorants, waxes, anti-oxidants, and coalescing agents. The solids content of the aqueous coating composition of the invention is from 30% to 80% by weight. The viscosity of the aqueous coating composition prior to application on the paper or paper board is preferably less than about 4000 cP, preferably more than 50 cps, as measured using a Brookfield viscometer.

The composition of this invention provides improved viscosity stability to latex formulations containing pigments and/or fillers, i.e., it reduces the change in viscosity that occurs upon equilibration or aging. The composition also may have reduced formation of masses of flocculated particles, which tend to settle out of coating compositions.

EXAMPLE 1

Preparation of an Aqueous Dispersion of Phosphorous-Containing Polymer Particles A monomer emulsion was prepared by combining 576 g of deionized (DI) water, 21.1 g of dodecylbenzene sulfonate surfactant (23 weight % active), 38.6 g of an ethoxylated monoalkyl sulfosuccinate surfactant (30 weight % active), 38.6 g acrylic acid, 1255.3 g butyl acrylate, 154.8 g acrylonitrile, 425 g styrene, and 57.9 g of phosphoethyl methacrylate (50% active). To a five liter, four-neck round bottom flask equipped with stirrer and condenser, and containing 664 g DI water, 12.6 g dodecylbenzene sulfonate (23%), 1.44 g sodium sulfate, and 0.4 g of 4-hydroxy TEMPO (5% active) at 87° C. was charged 102.7 g of the monomer emulsion, followed by 5.9 g sodium persulfate dissolved in 32.4 g DI water, and rinsed to the flask with an additional 22.6 g DI water. After ten minutes, the remaining monomer emulsion and a solution of 5.9 g sodium persulfate and 8.6 g sodium hydroxide (50% active) in 203.4 g DI water were added separately to the flask over three hours. The temperature of the batch was maintained at 87° C. during the addition. When all additions were completed, the containers were rinsed to the flask with 15.2 g DI water. Separate catalyst and activator charges consisting of 14.3 g t-butyl hydroperoxide (70%) and 8.8 g sodium bisulfite in DI water were added in three portions over 90 minutes while cooling the batch to 45° C., and a neutralizer solution consisting of 42.6 g sodium hydroxide (50%) in 253.9 g DI water was added during the same period. The batch was finished off with the addition of 8.1 g Kathon LX solution (1.4% active), and 1.17 g of Drewplus T-3200 defoamer. The aqueous polymer dispersion of Example 1 contained 49 weight % solids and had a pH of 7.6. Using this procedure, two latexes Example 1A (particle size ca. 90 nm) and Example 1B (Particle size ca. 130 nm)

EXAMPLE 2

Preparation of an Aqueous Dispersion of Phosphorous-Containing Polymer Particles A monomer emulsion was prepared by combining 497 g of deionized (DI) water, 19.3 g of dodecylbenzene sulfonate surfactant (23 weight % active), 17.7 g of an ethoxylated monoalkyl sulfosuccinate surfactant (30 weight % active), 44.4 g acrylic acid, 1452.9 g butyl acrylate, 88.6 g acrylonitrile, 132.9 g styrene, and 53.2 g of phosphoethyl methacrylate (50% active). To a five liter, four-neck round bottom flask equipped with stirrer and condenser, and containing 715 g DI water, 2.2 g dodecylbenzene sulfonate (23%), 2.7 g sodium sulfate, and 0.08 g of 4-hydroxy TEMPO (5% active) at 87° C. was charged 69.2 g of the monomer emulsion, followed by 5.3 g ammonium persulfate dissolved in 35 g DI water. After five minutes, the remaining monomer emulsion and a solution of 5.3 g sodium persulfate in 100 g DI water, and 7.3 g sodium hydroxide (50% active) in 65 g DI water were added separately to the flask over 2.5 hours. The temperature of the batch was maintained at 86° C. during the addition. When all additions were completed, the containers were rinsed to the flask with 40 g DI water. Separate catalyst and activator charges consisting of 3.8 g t-butyl hydroperoxide (70%)/2.7 g sodium bisulfite in 95 g DI water and 4.9 g t-butyl hydroperoxide (70%)/3.5 g isoascorbic acid in 110 g DI water were added, each over 30 minutes while cooling the batch to 75° C. While further cooling the batch to 45° C., charges were added in succession of 1.1 g Drewplus T-3200 defoamer, a solution of 15.4 g sodium hydroxide (50%) and 22.6 g ethoxylated monoalkyl sulfosuccinate (30%) with 48 g DI water, and 7.9 g Kathon LX solution (1.4% active) in 25 g DI water. The aqueous polymer dispersion of Example 2 contained 49.3 weight % solids and had a pH of 6.0.

EXAMPLE 3

A 5% tetra sodium pyrophosphate decahydrate solution in water was prepared by dissolving 5 grams of this material in 95 grams of water.

EXAMPLES 4A-C

Coating Formulations and Viscosity Data

| Material name | | 4A Dry Parts | 4B Dry Parts | 4C Dry Parts |
|---|---|---|---|---|
| Clay(20)/Calcium Carbonate (80) slurry | | 100 | 100 | 100 |
| Latex binder (example 1) | | 10 | 10 | 10 |
| RM-232 (Thickner) | | 0.2 | 0.2 | 0.21 |
| Tetra Sodium Pyrophosphate (TSPP) | | 0 | 0.5 | 1 |
| Total parts | | 110.2 | 110.7 | 111.2 |
| Coating Solids (%) | | 59 | 59 | 59 |
| Brookfield Viscosity (cP), # 3 spindle, 60 rpm | Initial | 750 | 800 | 1000 |
| | 2 h | 7200 | 1275 | 1982 |

Examples 4b and 4c with tetra sodium pyrophosphate show lower viscosity build over 2 h compared to 4a without tetra sodium pyrophosphate.

EXAMPLE 5

Preparation of Sodium Hexametaphosphate Solution

A 50% sodium hexametaphosphate (Calgon-N purchased from BK Giuilini, Calif., USA) solution in water was prepared by dissolving 50 grams of this material in 50 grams of water. This solution was used in the examples below, where indicated

EXAMPLES 6A-G

Coating Formulations and Viscosity Over Time Data

The ingredients used in the table below are Hydrocarb-90 (calcium carbonate) obtained from Omya, Inc.; SPS (clay of regular brightness) purchased from Imerys, Inc.; AF-1055 ER (hollow plastic pigment) and Primal 308 AF (styrene-acrylate binder) available as commercial products from the Rohm and Haas Company, Philadelphia, Pa.; Rhoplex RM-232D, a thickener (hydrophobically-modified, low foam version alkali-swellable emulsion (HASE)) also available from Rohm and Haas. These materials were used to make the following coating formulations.

| | | Coatings | | | | | | |
|---|---|---|---|---|---|---|---|---|
| | | 6A | 6B | 6C | 6D | 6E | 6F | 6G |
| Coating Ingredients | | Dry parts by weight (unless otherwise noted) | | | | | | |
| Hydrocarb 90 (calcium carbonate) | | 70 | 70 | 70 | 70 | 70 | 100 | 100 |
| SPS (clay) | | 25 | 25 | 25 | 25 | 25 | | |
| AF 1055ER | | 5 | 5 | 5 | 5 | 5 | | |
| Primal 308AF | | 10 | | | | | | |
| Latex from Example 1 | | | 10 | 10 | 10 | 10 | 10 | 10 |
| Calgon-N solution (wt % on latex binder solids) | | 0 | 0 | 2 | 4 | 5 | 6 | 2 |
| Rhoplex RM 232DE | | 0.02 | 0.02 | 0.05 | 0.02 | | | |
| Coating Solids (%) | Time (h) | 64 | 64 | 64 | 64 | 64 | 64 | 64 |
| | | Viscosity (cP) | | | | | | |
| Brookfield Viscosity (# 4 spindle, 100 rpm) | 0 | 700 | 685 | 687 | 685 | 664 | 350 | 198 |
| | 0.25 | | 1224 | 854 | | | 580 | |
| | 0.5 | 736 | 2052 | | 907 | 878 | | 426 |
| | 0.92 | | | | | | | |
| | 2 | 766 | | 1080 | 1014 | 972 | 630 | |
| | 4 | | | | 1156 | | 780 | |
| | 5 | | | | 1276 | | | |
| | 6 | 760 | 6180 | 1534 | | 1220 | 1100 | |
| | 8 | | | | | 1350 | | |
| | 16 | | | | | | | 3830 |
| | 18.5 | | | | | | | 4160 |
| | 24 | | | 3128 | 2084 | 1664 | 1280 | |
| | 48 | 850 | | 5130 | | 1950 | | |
| | 96 | | | | 3352 | | | |

Examples 6A and 6B show that a paper coating formulation with phosphorous-containing latex shows a significant increase viscosity, and examples B-G show that this viscosity increase can be controlled by Calgon-N dispersant there by providing stable paper coating colors.

EXAMPLE 7

Coating formulations 7A-I were made (whose main ingredients are given in the table below) and coated on both sides (C2S) of a freesheet base stock (65 gsm) at the KCL (Finland) pilot coater using a jet-coater head running at 1800 m/min. The coatings 7 D-I were made from the experimental latexes 1A and 1B that were pre-mixed with 50 wt % aqueous solution of Calgon-N such that it was 3 wt % on latex solids. The applied coat weight on the sheet was 7 gsm on each side. The coated sheets were calendered on a off-line supercalender running at speed of 1500 m/min with 9 nips and at temperatures of 60-90 deg C. and a pressure of 200 kN/m to a target gloss of ca. 70 as measured by the on-line gloss meter (75 deg gloss).

| | Coatings | | | | | | | | |
|---|---|---|---|---|---|---|---|---|---|
| | 7A | 7B | 7C | 7D | 7E | 7F | 7G | 7H | 7I |
| Ingredients | Dry Parts By Weight | | | | | | | | |
| CaCO3 Covercarb 75 | 80 | 80 | 80 | 80 | 80 | 80 | 80 | 80 | 80 |
| Clay HG-90 | 20 | 20 | 20 | 20 | 20 | 20 | 20 | 20 | 20 |
| Primal P-308AF | 12 | 11 | 10 | | | | | | |
| Exp. Latex (Example 1A + Calgon-N)) | | | | 12 | 11 | 10 | | | |
| Exp. Latex (Example 1B + Calgon-N)) | | | | | | | 12 | 11 | 10 |
| pH | Ca. 8.5 | | | | | | | | |
| Solids (wt %) | 58.5 | | | | | | | | |

Papers coated with above coatings 7A-I were tested in the lab for general optical properties (75 deg gloss using a bench top glossmeter from Technidyne (New Albany, Ind.)). The same papers were tested for Vandercook wet pick coating strength using a laboratory Prufbau printing station. The conditions for the wet pick coating strength tests were as the following: sheet-fed cyan ink (0.18 g), pressure, 800N; printing speed, 1.2 m/s; inking time, 30 sec; water: 10 microliter droplet. The prints are rated from 1-5 where 1 is represents the highest strength and 5 the lowest.

| | Coatings | | | | | | | | |
|---|---|---|---|---|---|---|---|---|---|
| | 7A | 7B | 7C | 7D | 7E | 7F | 7G | 7H | 7I |
| Gloss (75 deg) | 69 | 73.5 | 72.9 | 70.9 | 73.1 | 73.8 | 70.6 | 71.8 | 71.3 |
| Wet Pick rating | 4 | 3 | 5 | 2 | 2 | 2 | 3 | 2 | 2 |

The ratings above show that the experimental latexes with phosphate monomers incorporated impart higher coating strength compared to the regular styrene-acrylate latex.

We claim:

1. A paper or paper board product comprising a paper (uncoated basis weight: 35-178 gsm) or paperboard (uncoated basis weight: 195-586 gsm) that bears a dried aqueous coating composition comprising:

(a) pigment particles;

(b) particles of acrylic or vinyl polymer containing phosphate or phosphonate groups; and (c) a compound of formula (I) or (II):

(I)

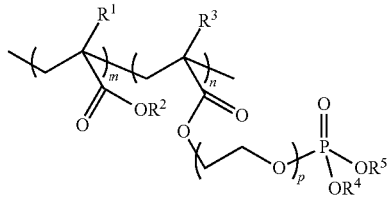

(II)

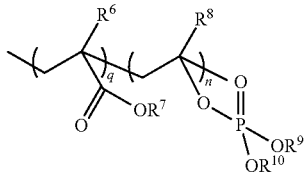

$R^1$, $R^3$, $R^6$, $R^8$ are independently hydrogen or alkyl groups, $R^2$, $R^4$, $R^5$, $R^7$, $R^9$ & $R^{10}$ are independently hydrogen, alkyl groups or ammonium or metal counter ions, or wherein R5 is a residue of a phosphoethyldimethacrylate that is in turn optionally polymerized with other ethylenically unsaturated monomers or dimers; wherein each of the sums (m+n) and (q+r) is an integer from 10 to 600, and p is an integer from 1-10; and wherein each of the ratios m:n and q:r is from 0:100 to 95:5.

2. The paper or paper board product of claim 1 wherein the pigment particles are selected from among the group consisting of titanium dioxide, zinc oxide, clay, talc, calcium carbonate and combinations thereof.

3. The paper or paper board product of claim 1 wherein the composition comprises calcium carbonate.

4. The paper or paper board product of claim 1 wherein the acrylic polymer containing phosphate or phosphonate groups has a $T_g$ from −30° C. to 60° C.

5. The paper or paper board product of claim 4 wherein the acrylic polymer containing phosphate or phosphonate groups comprises residues of phosphoalkyl (meth)acrylate.

6. The paper or paper board product of claim 1 wherein the coating composition prior to application on the product has a viscosity of less than about 4000 cP, as measured with a #3 spindle at 60 rpm or a #4 spindle at 100 rpm.

7. The paper or paper board product of claim 1 wherein the weight ratio of the acrylic or vinyl polymer containing phosphate or phosphonate groups to the compound of formulae (I) or (II) is 1:0.001 to 1:2.

8. The paper or paper board product of claim 1 wherein the particles of vinyl polymer containing phosphate or phosphonate groups comprise 0.5% to 8% phosphate- or phosphonate-containing monomer units, based on the total amount of acrylic or vinyl polymer on a solids basis.

9. The paper or paper board product of claim 1 wherein the particles of acrylic or vinyl polymer containing phosphate or phosphonate groups are substantially free of monomer units other than those of acrylic acid, methacrylic acid, and their esters.

10. The paper or paper board product of claim 1 wherein the particles of acrylic or vinyl polymer containing phosphate or phosphonate groups consist of butyl acrylate, acrylonitrile, styrene, and phosphoethyl methacrylate monomer units.

* * * * *